US010194699B2

(12) United States Patent
De

(10) Patent No.: US 10,194,699 B2
(45) Date of Patent: Feb. 5, 2019

(54) PAIR OF SOCKS OR STOCKINGS THAT CAN BE REMOVABLY CONNECTED TO ONE ANOTHER AND HAVE AN IMPROVED DURABILITY

(76) Inventor: Dennis De, Kusterdingen (DE)

( * ) Notice: Subject to any disclaimer, the term of this patent is extended or adjusted under 35 U.S.C. 154(b) by 954 days.

(21) Appl. No.: 12/920,175

(22) PCT Filed: Mar. 5, 2009

(86) PCT No.: PCT/EP2009/001613
§ 371 (c)(1),
(2), (4) Date: Nov. 18, 2010

(87) PCT Pub. No.: WO2009/109392
PCT Pub. Date: Sep. 11, 2009

(65) Prior Publication Data

US 2011/0126344 A1 Jun. 2, 2011

(30) Foreign Application Priority Data

Mar. 7, 2008 (DE) ..... 10 2008 013 191

(51) Int. Cl.
*A41B 11/00* (2006.01)
*A41B 11/02* (2006.01)

(52) U.S. Cl.
CPC ..... *A41B 11/002* (2013.01); *A41B 11/02* (2013.01)

(58) Field of Classification Search
CPC ..... A41B 11/002; A41B 11/02; A41B 11/00; A41B 11/001; A41B 11/003; A41B 11/04;
(Continued)

(56) References Cited

U.S. PATENT DOCUMENTS 1,919,487 A * 7/1933 Thompson ..... D04B 1/26 66/182
2,251,268 A 8/1941 Clawson
(Continued)

FOREIGN PATENT DOCUMENTS

DE 8415660 U1 9/1984
DE 8600236 U1 8/1986
(Continued)

OTHER PUBLICATIONS

International Search Report, PCT/EP97/01837 (Published as WO/1997/038596, dated Oct. 23, 1997).
(Continued)

*Primary Examiner* — Amy Vanatta
(74) *Attorney, Agent, or Firm* — The Dobrusin Law Firm, P.C.

(57) ABSTRACT

The present invention relates to a pair of knitted socks or stockings which can be removably connected to one another, in which a first attachment part is firmly attached to one of the two socks or stockings in order to receive a second complementary attachment part in a removable manner, the attachment part being firmly connected to the other of the two socks or stockings, wherein the knitted fabric of the socks or stockings has a stitch density of at least 2000 SD at least in the attachment region of the respective attachment part and is knitted using a reinforcing thread which is not visible from the outside of the socks or stockings and has a tear resistance which corresponds to at least the average tear resistance of the tear resistances of the ground thread, the plating thread and the reinforcing thread of the knitted fabric, none of the threads having a tear resistance of <10 cN/tex.

20 Claims, 3 Drawing Sheets

(58) Field of Classification Search

Figure 1:
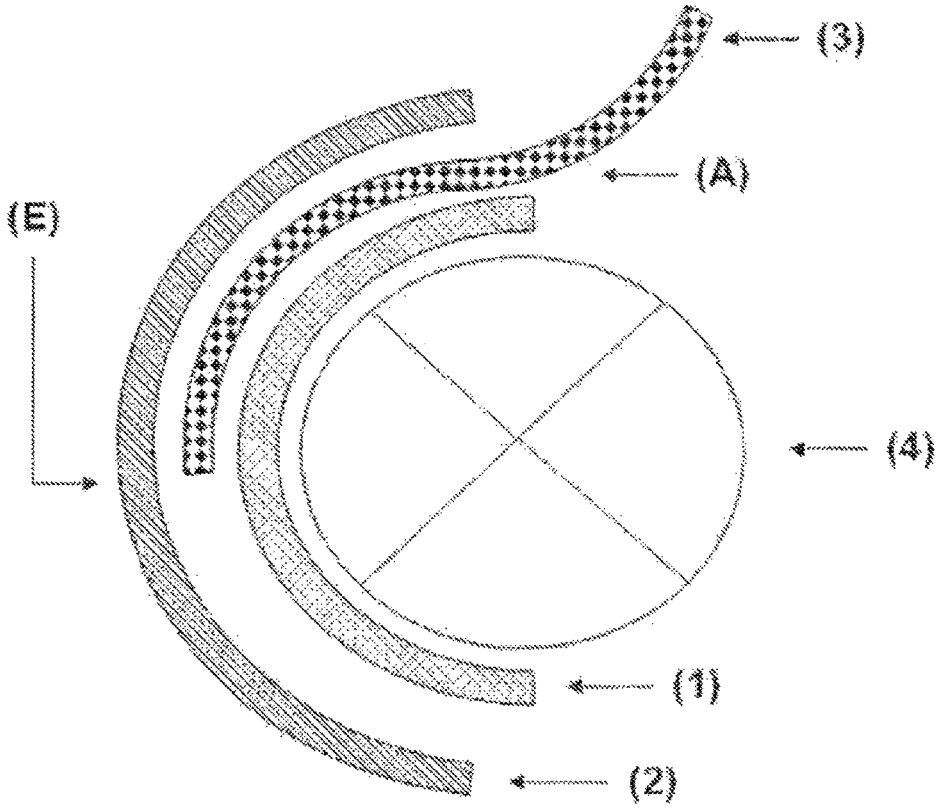

CPC ..... D06F 95/008; A41D 19/0034; A41D 19/0037; A41D 19/0041; A41F 1/00; A41F 11/00; A41F 11/02; A41F 11/04; A41F 11/18

USPC ..... 2/239–242, 265, 336

See application file for complete search history.

(56) References Cited

U.S. PATENT DOCUMENTS

| | | | | | |
|---|---|---|---|---|---|
| 2,663,877 | A | | 12/1953 | Bohman | |
| 2,667,004 | A | | 1/1954 | Sanson | |
| 3,423,764 | A | | 1/1969 | Cassling | |
| 3,466,714 | A | * | 9/1969 | Nysten | 24/689 |
| 3,538,557 | A | * | 11/1970 | Hirose | 24/679 |
| 3,688,348 | A | | 9/1972 | Klotz et al. | |
| 3,828,585 | A | | 8/1974 | Thorneburg | |
| 4,058,853 | A | | 11/1977 | Boxer et al. | |
| 4,106,126 | A | | 8/1978 | Traenkle | |
| 4,165,555 | A | | 8/1979 | Boxer et al. | |
| 4,216,662 | A | * | 8/1980 | Harris, Jr. | D04B 1/26 66/185 |
| 4,277,959 | A | | 7/1981 | Thorneburg | |
| 4,344,240 | A | * | 8/1982 | Schiller | 40/662 |
| 4,520,635 | A | | 6/1985 | Shields et al. | |
| 4,682,389 | A | * | 7/1987 | Callender | 24/601.7 |
| 4,710,979 | A | * | 12/1987 | Bull et al. | 2/48 |
| 5,038,413 | A | * | 8/1991 | Ursino | A41B 11/002 2/239 |
| 5,308,671 | A | * | 5/1994 | Wells | 428/99 |
| 5,321,855 | A | | 6/1994 | Ciuffo | |
| 5,335,517 | A | * | 8/1994 | Throneburg et al. | 66/185 |
| 5,357,660 | A | | 10/1994 | Smith | |
| 5,359,759 | A | * | 11/1994 | Jacob et al. | 28/271 |
| 5,367,809 | A | * | 11/1994 | Ross | 40/668 |
| 5,450,658 | A | * | 9/1995 | Hicks | 24/303 |
| 5,579,541 | A | | 12/1996 | Christy et al. | |
| 5,699,557 | A | | 12/1997 | Johnson | |
| 5,740,558 | A | | 4/1998 | Messman | |
| 5,918,318 | A | * | 7/1999 | Jones | 2/239 |
| 5,926,925 | A | * | 7/1999 | Hicks | 24/303 |
| 5,970,524 | A | * | 10/1999 | Becker et al. | 2/239 |
| 5,974,590 | A | * | 11/1999 | Stubbs | 2/239 |
| 6,032,294 | A | * | 3/2000 | Dean | 2/239 |
| 6,067,659 | A | * | 5/2000 | Reichle | 2/239 |
| 6,075,177 | A | * | 6/2000 | Bahia et al. | 602/43 |
| 6,092,241 | A | * | 7/2000 | Bellet | 2/239 |
| 6,185,751 | B1 | * | 2/2001 | Mason | 2/239 |
| 6,216,279 | B1 | * | 4/2001 | Ellingson | 2/239 |
| 6,218,011 | B1 | * | 4/2001 | Raetzsch et al. | 428/394 |
| 6,237,158 | B1 | * | 5/2001 | Barbara | 2/239 |
| 6,279,169 | B1 | * | 8/2001 | Reichle | 2/239 |
| 6,318,283 | B1 | * | 11/2001 | Coulthard, Jr. | 112/475.12 |
| 6,374,420 | B2 | * | 4/2002 | Jossi | 2/239 |
| 6,468,655 | B1 | * | 10/2002 | Kato et al. | 428/395 |
| 6,990,694 | B2 | * | 1/2006 | Poole | 2/239 |
| 7,058,986 | B2 | * | 6/2006 | Pietzyk-Hardy | 2/239 |
| 7,150,081 | B2 | * | 12/2006 | Juan | 24/584.1 |
| 7,441,419 | B1 | * | 10/2008 | Dollyhite et al. | 66/178 A |

FOREIGN PATENT DOCUMENTS

| | | | | | |
|---|---|---|---|---|---|
| DE | 3803788 | A | | 3/1989 | |
| DE | 19957887 | | * | 6/2001 | D04B 1/26 |
| DE | 19957887 | A1 | | 6/2001 | |
| EP | 62969 | A2 | | 10/1982 | |
| EP | 0244388 | A2 | | 11/1987 | |
| EP | 0808927 | A1 | | 11/1997 | |
| FR | 2722062 | A1 | | 1/1996 | |
| WO | 91/04684 | A1 | | 4/1991 | |
| WO | 96/10345 | A2 | | 4/1996 | |
| WO | 97/38596 | A1 | | 10/1997 | |

OTHER PUBLICATIONS

International Search Report, PCT/EP2009/001613 (Published as WO2009/109392) dated Mar. 12, 2009.

* cited by examiner

PAIR OF SOCKS OR STOCKINGS THAT CAN BE REMOVABLY CONNECTED TO ONE ANOTHER AND HAVE AN IMPROVED DURABILITY

CLAIM OF BENEFIT OF FILING DATE

The present application claims the benefit of the PCT Application No. PCT/EP2009/001613, filed Mar. 5, 2009 (Published as WO2009/109392); Germany Application 10 2008 013 191.1, filed Mar. 7, 2008; the contents of which are hereby incorporated by reference in their entirety.

The present invention relates to a pair of socks or stockings which can be removably connected to one another, in which a first attachment part is firmly attached to one of the two socks or stockings in order to receive a second complementary attachment part in a removable manner, said attachment part being firmly connected to the other of the two socks or stockings, wherein the knitted fabric of the socks or stockings has a stitch density of at least 2000 SD at least in the attachment region of the respective attachment part and is knitted using a reinforcing thread which is not visible from the outside of the socks or stockings and has a tear resistance which corresponds to at least the average tear resistance of the tear resistances of the ground thread, the plating thread and the reinforcing thread of the knitted fabric, none of the threads having a tear resistance of <10 cN/tex.

It is already known to join a pair of socks or stockings together in a removable manner if they are not going to be worn, to avoid having to sort socks which belong together it is a not an uncommon occurrence that, after several pairs of socks or stockings have been washed, non-matching pairs are then kept together because they are of a similar colour, particularly in artificial light. However, in natural light, such differences are much more obvious, possibly resulting in awkwardness when the socks or stockings are worn.

Therefore, according to WO97/38596, an attempt was made to solve this problem in that a first attachment part was firmly secured to a respective stocking or sock of a matching pair in order to receive a second complementary attachment part in a removable manner and the second complementary attachment part is also firmly joined to the respective other sock or stocking.

The respectively complementary parts of the attachment parts which are to connect a pair of socks or stockings to one another in a removable manner can be the parts of a snap fastener, a Velcro strip fastener, a push-in fastener, a twist fastener or a hook and eye fastener.

The attachment parts are firmly connected in each case to the sock or stocking, preferably by adhesive bonding, sewing or snapping on WO97/38596).

This known combination makes it possible to movably join together matching socks or stockings in a robust and only temporary manner such that the mentioned disadvantages do not occur. However, with this combination for connecting matching socks and stockings, problems can still arise because, after a relatively long period of wear of the socks or stockings and in particular after repeated washing, the attachment parts connected to the socks or stockings can become detached. Thus, practically no guarantee can be given for a lasting attachment of these attachment parts, suitable for the removable connection of socks or stockings, to the knitted fabric for the usual life of socks or stockings.

Indeed, there have been numerous prior art proposals for preventing the wearing away of socks or stockings in the heel or toe regions or of the entire foot part which comes into contact with the inside of a shoe by simultaneously knitting in an additional thread (U.S. Pat. No. 4,216,662, EP-A-0808927). However, rubbing and abrasive actions, caused by wearing socks or stockings are in no way comparable with stresses to which the combination of attachment parts is subjected in the connected state, for example by the compressive and centrifugal forces which arise during the washing procedure.

Therefore, as opposed to the prior art, the object to be achieved was to provide a pair of socks or stockings whose combination of attachment parts which can be connected together in a removable manner lasts the usual life of socks or stockings, with interspersed cleaning processes, without forfeiting the usability thereof.

This object is achieved according to the invention by the provision of a pair of knitted socks or stockings which can be joined together in a removable manner, whereby a first attachment part is firmly attached to one of the two socks or stockings in order to receive a second complementary attachment part in a removable manner, said attachment part also being firmly connected to the other of the two socks or stockings, which pair of knitted socks or stockings is characterised in that the knitted fabric of the socks or stockings has a stitch density of at least 2000 SD at least in the attachment region of the respective attachment part and is knitted using a reinforcing thread which is not visible from the outside of the socks or stockings and has a tear resistance which corresponds to at least the average tear resistance of the tear resistances of the ground thread, the plating thread and the reinforcing thread of the knitted fabric, none of the threads having a tear resistance of <10 cN/tex.

According to the invention, the outside of a sock or stocking is understood as meaning the surface of the sock or stocking which is positioned on the outside when the sock or stocking is worn, the so-called right side of the product.

According to a preferred embodiment of the invention, the first and second, preferably heat-resistant attachment parts are in each case the complementary parts of a snap fastener, a Velcro strip fastener, a push-in fastener, a twist fastener or a hook and eye fastener.

The attachment parts are preferably boil and/or heat-resistant, in a further preferred embodiment of the invention, the first and second attachment parts are either sewn on each of the two socks or stockings of a pair or adhesively bonded thereon using a suitable boil and/or heat-resistant adhesive.

In a further embodiment also preferred according to the invention, the first and second attachment parts are each attached to a preferably heat-resistant counter-part which is positioned on the respective other side, preferably the inside (=left side of the product) of the sock or stocking and can optionally penetrate through the sock or stocking.

This push-in connection can preferably be removed before the sock or stocking is worn so that, although the attachment parts are firmly connected to the sock or stocking, they are preferably not permanently connected thereto. This can prevent an uncomfortable pressing and rubbing on the wearer which may occur. After the socks or stockings have been worn, the first and second attachment parts are each fitted with the push-in connection and the respective pair are joined together, for example to be washed.

More preferably the first and second attachment parts are fitted in the leg part, and most preferably are fitted externally on the inside or outside of the leg part of the sock or stocking. The inside leg part of the sock or stocking is particularly preferred in each case for fitting the attachment part.

According to the invention, the inside leg part or outside leg part of a sock or stocking is understood as meaning the side of a leg part which covers the inside of the leg, or the outside of the leg when the sock or stocking is worn.

According to a further embodiment of the present invention, the first and second attachment parts are in each case the complementary parts of a snap fastener, a Velcro strip fastener, a twist fastener or a hook and eye fastener which are produced from a rust-free material, preferably from a plastics material or metal, most preferably from metal, the material preferably being boil and/or heat-resistant and preferably also being suitable for people with allergies.

To ensure the life of the removable connection of attachment parts at least during the usual service life of socks or stockings with more than 100, preferably more than 200, more preferably more than 300 interspersed washes without the attachment parts or a separable push-in device becoming detached, the knitted fabric of the socks or stockings must have, at least in the attachment region of the respective attachment part, a stitch density of at least 2000 SD (determined according to DIN 53883) and the knitted fabric must be knitted, at least in the attachment region, using a reinforcing thread having a tear resistance which corresponds to at least the average tear resistance of the tear resistances of the ground thread, the plating thread and the reinforcing thread, none of the three threads having a tear resistance of less than 10 cN/tex.

More preferably, the stitch density is at least 4000 SD in this attachment region, particularly if a snap fastener, a push-in fastener or a removable hook and eye fastener is fitted to join together a pair of socks or stockings.

The average tear resistance Rm can be calculated using the following equation:

$$Rm = \frac{Rg + Rp + Rv}{3}$$

where Rg, Rp and Rv represent the respective tear resistances of the ground thread, the plating thread and the reinforcing thread and are measured according to DIN EN ISO 2062 and are given in the unit [cN/tex].

According to a particularly preferred embodiment of the present invention, the average tear resistance of the knitted fabric, at least in the attachment region of the respective attachment part, is at least 15 cNtex, calculated as stated above. Furthermore, according to a particularly preferred embodiment of the present invention, the tear resistance of the reinforcing thread is greater by at least 20% than the tear resistance of the ground thread of the knitted fabric.

According to a further preferred embodiment of the present invention, in this knitted fabric, the diameter of the reinforcing thread can correspond at the most to the diameter of the plating thread. Furthermore, the reinforcing thread and the plating thread can consist of the same material. Likewise, the ground thread and the plating thread can consist of the same material or of different materials.

The reinforcing thread preferably consists of plastics material, more preferably of polyamide or polyester, or at least partly of a natural material, preferably hemp, cotton, sheep's wool, natural silk or a mixture of at least two of these natural materials.

Insofar as the ground thread and the plating thread of the knitted fabric consist of the same or different materials, these materials can be selected from the group comprising natural materials, preferably cotton, sheep's wool, silk, and synthetic materials, preferably plastics materials, preferably polyamides or polyesters.

According to a further possible embodiment of the present invention, the ground thread, the plating thread and the reinforcing thread of the knitted fabric can be dyed. At least the ground thread and the plating thread preferably have the same colour. The reinforcing thread is preferably transparent, preferably colourlessly transparent.

At least the region in which the respective attachment part is fitted to the sock or stocking is preferably knitted using the reinforcing thread. More preferably, this region is knitted using a reinforcing thread up to a circle of a least 1 cm around the attachment part in order to achieve the necessary average tear resistance. This region, which is knitted using a reinforcing thread, can preferably have an oval, circular, rectangular shape, more preferably a circular or oval shape, in which the respective attachment part is fitted.

In a further preferred embodiment of the present invention, at least the respective attachment region for the respective attachment part on a pair of socks or stockings is knitted by the so-called sandwich plating method, in particular according to the jacquard float plating method. In this method, a reinforcing thread is knitted in according to the invention in addition to a ground thread and a plating thread. These methods are particularly suitable for the production of the knitted fabric in the region of the attachment part, because by said methods the reinforcing thread can be knitted in such that it is invisible in the knitted fabric. According to these methods, only the plating thread is visible on the so-called right side of the product, i.e. on the outside of the sock or stocking, and only the ground thread is visible on the left side of the product, i.e. on the inside of the knitted sock or stocking. The interpositioned reinforcing thread cannot be seen in these methods.

The mentioned knitting methods are current knitting methods which are used inter alia, for knitting socks or stockings. They are described, for example, in "Strumpf- und Feinstrumpfstrickerei Arbeitsergebnis Gesamttextil", Frankfurt am Main, 1987, pages 4 and 13, ISSN 0176-8697. The corresponding disclosure in the mentioned publication is hereby entered as a reference and is considered part of the disclosure of the present invention.

In order for the reinforcing thread to be invisible on the outside, i.e. on the right side of the sock or stocking, preferably to be invisible both on the inside and on the outside of the sock or stocking, the reinforcing thread is arranged in the stitch between the ground thread and the plating thread.

FIG. 1 reproduces, in a plan view, the thread arrangement in the region of the reinforcing thread.

According to FIG. 1, the reinforcing thread (3) is arranged between the ground thread (1) and the plating thread (2). According to a preferred embodiment shown in FIG. 1, inserted at the start (A) of each row in addition to the ground thread (1) is a reinforcing thread (3) which is severed again at the end (E) of the reinforcing region, while the ground thread (1) and the plating thread (2) continue to be knitted. Reference numeral (4) denotes the knitting cylinder which rotates in an anti-clockwise direction.

Figure 2:
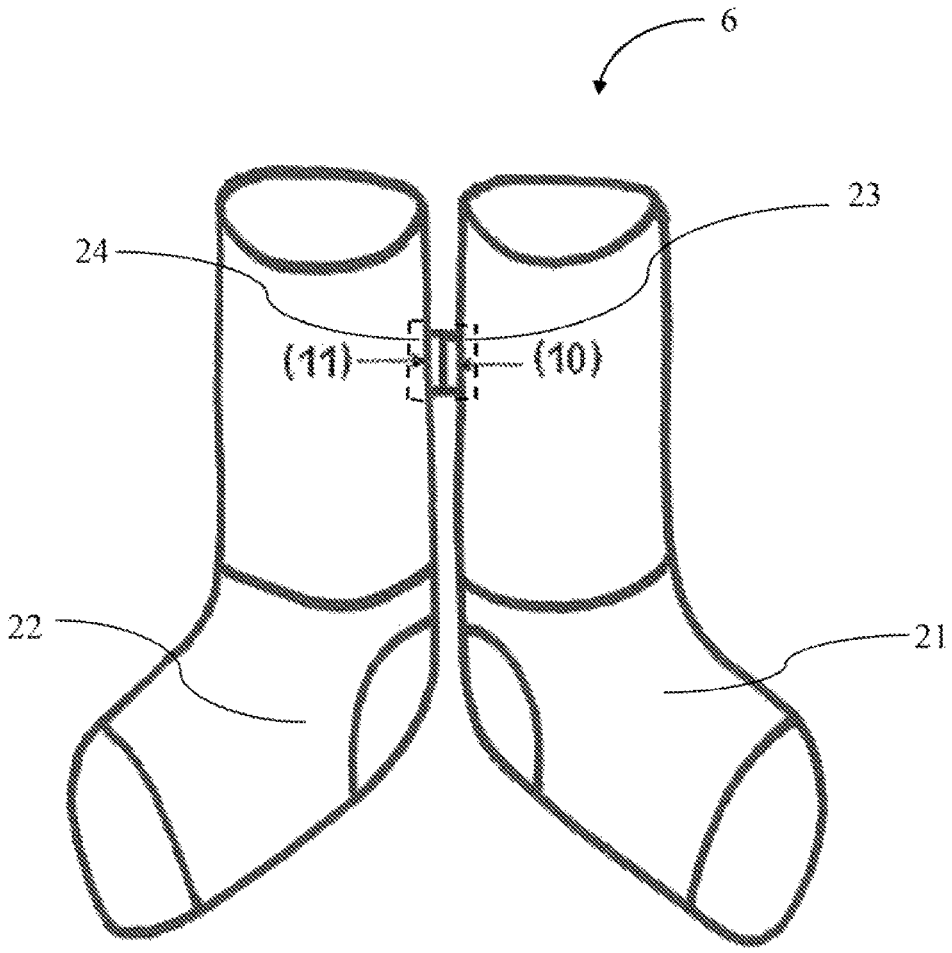

FIG. 2 is a drawing of an illustrative pair of socks or stockings 6. The socks or stockings 6 are connected by a first attachment part 10 and the second complementary attachment part 11. The pair of socks or stockings 6 includes a first sock or stocking 21 and a second sock or stocking 22. The first attachment part 10 is firmly attached to the first sock or stocking 21 at an attachment region 23 of the first sock or stocking 21. The second complementary part 11 is firmly attached to the second sock or stocking 22 at an attachment region 24 of the second sock or stocking 22.

Figure 3A:
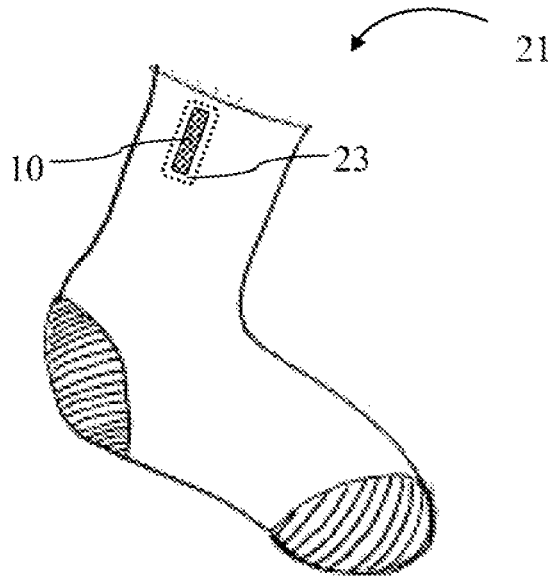
Figure 3B:
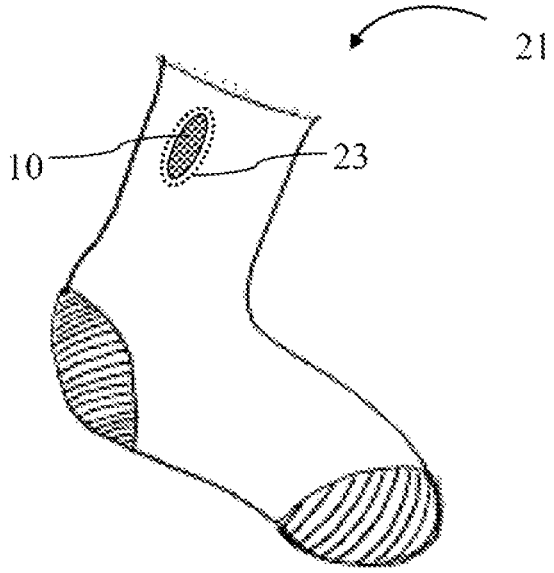

FIG. 3*a* and FIG. 3B are drawings of illustrative socks or stockings 21 according to the teachings herein, having a first attachment part 10 and an attachment region 23. The first attachment part 10 preferably is rectangular or oval shaped. The attachment region 23 is preferably rectangular or oval shaped.

As already mentioned, in this sandwich plating knitting method, advantageously inserted at the start (A) of each row in addition to the ground thread (1) is a reinforcing thread (3) which is severed again at the end (E) of the reinforcing region, while the ground thread (1) and the plating thread (2) continue to be knitted. In addition, this procedural method makes it possible for the shape of the reinforcing region to be varied and, if appropriate, to be adapted to the shape of the attachment part to be attached by the selection of the needles for knitting the reinforcing thread and by the respective severing of said reinforcing thread.

Therefore, a further object of the present invention is also a method for attaching a combination of preferably complementary attachment parts which can be connected together in a removable manner to an attachment region of the respective sock or stocking of a matching pair of socks or stockings, the suitable attachment parts having already been specified above, in which method the knitted fabric of the respective sock or stocking in the attachment region, preferably up to a circle of at least 1 cm, but preferably not the entire knitted fabric of the respective sock or stocking, is knitted using a reinforcing thread according to a plating method with a stitch density of at least 2000 SD, the tear resistance of the reinforcing thread corresponding to at least the average tear resistance of the tear resistances of the ground thread, the plating thread and the reinforcing thread of the knitted fabric and none of the threads having a tear resistance of <10 cN/tex, and the respective attachment parts of the removable connection each being fitted thereto.

In a further preferred embodiment, the attachment region is knitted according to this procedural method, such that the region has an oval, circular or rectangular shape, more preferably a circular or oval shape.

Furthermore, a further preferred embodiment of the method according to the invention is that the plating knitting method is carried out such that, in the knitted fabric which is obtained, the reinforcing thread cannot be seen from the outside of the sock or stocking, preferably from both sides of the sock or stocking, i.e. from the right and left sides of the product.

This means that preferably the simultaneous use of the reinforcing thread in the production of the socks or stockings equipped according to the invention is only necessary in the region in which the attachment part is fitted, and optionally up to a specific circle thereof, preferably in the leg part of the sock or stocking, and is by no means required for the production of the entire sock or stocking.

A further object of the present invention is a pair of socks or stockings which can obtained according to any of the methods stated above.

The invention claimed is:

1. A pair of knitted socks or stockings including a first sock or stocking and a second sock or stocking which can be removably connected to one another comprising:

a first attachment part and a second complementary attachment part, wherein the first attachment part is firmly attached to the first sock or stocking in order to receive the second complementary attachment part in a removable manner, and wherein the second complementary attachment part is firmly connected to the second sock or stocking, and the first sock or stocking includes a first reinforced region located at a leg portion of the first sock or stocking for attaching the first attachment part and the second sock or stocking includes a second reinforced region located at a leg portion of the second sock or stocking for attaching the second complementary attachment part, wherein each sock or stocking includes an unreinforced region located at the leg portion, and wherein a knitted fabric of the pair of socks or stockings has a stitch density of at least 2,000 SD, determined according to DIN 53883 and an average tear resistance of at least 15 cN/tex, at least in the first and second reinforced regions, and wherein the first and second reinforced regions are knitted using a combination of a ground thread, a reinforcing thread, and a plating thread up to a circle of at least 1 cm around the attachment part, and the unreinforced regions are free of the reinforcing thread, and wherein the reinforcing thread has a tear resistance which corresponds to at least the average tear resistance of the tear resistances of the ground thread, the plating thread, the reinforcing thread of the knitted fabric of at least 15 cN/tex, none of the threads having a tear resistance of less than 10 cN/tex, and the attachment parts are capable of remaining attached to the first and second reinforced regions for a service life of more than 300 interspersed washes.

2. The pair of socks or stockings according to claim 1, wherein the first and second reinforced regions each has an oval or rectangular shape; and the knitted fabric of the pair of socks or stockings has a stitch density of at least 4,000 SD, determined according to DIN 53883, at least in the first and second reinforced regions.

3. The pair of socks or stockings according to claim 1, wherein the diameter of the reinforcing thread corresponds at the most to the diameter of the plating thread.

4. The pair of socks or stockings according to claim 1, wherein the ground thread, the reinforcing thread, and the plating thread consist of different materials.

5. The pair of socks or stockings according to claim 1, wherein the first attachment part is fitted to an outside leg part of the first sock or stocking, and the second complementary attachment part is fitted to an outside leg part of the second sock or stocking.

6. The pair of socks or stockings according to claim 1, wherein the first attachment part and the second complementary attachment part are each complementary parts of a twist fastener.

7. The pair of socks or stockings according to claim 1, wherein the first attachment part and second complementary attachment part are each adhesively bonded, sewn, or pushed onto the sock or stocking.

8. The pair of socks or stocking according to claim 5, wherein the reinforcing thread includes a polyester.

9. The pair of socks or stockings of claim 1, wherein the reinforcing thread consists of a synthetic material.

10. The pair of sock or stockings of claim 9, wherein the synthetic material includes a polyamide or a polyester.

11. The pair of sock or stockings of claim 10, wherein the ground thread includes a natural material.

12. The pair of socks or stockings of claim 11, wherein the natural material includes cotton, sheep's wool, or silk.

13. The pair of socks or stockings of claim 9, wherein the plating thread includes a natural material.

14. The pair of socks or stockings of claim 13, wherein the natural material includes cotton, sheep's wool, or silk.

15. The pair of socks or stockings of claim 10, wherein only the plating thread is visible on an outside of the sock or stocking.

16. The pair of socks or stockings of claim 10, wherein the plating thread and the ground thread are different materials.

17. The pair of socks or stockings of claim 16, wherein the reinforcing thread is arranged between the ground thread and the plating thread.

18. The pair of socks or stockings of claim 13, wherein the ground thread consists of a synthetic material.

19. The pair of socks or stockings of claim 11, wherein the plating thread consists of a synthetic material.

20. A method for attaching a combination of attachment parts which can be removably connected to one another in a reinforced region of a leg portion of a respective sock or stocking of a matching pair of socks or stockings comprising:

obtaining or knitting the matching pair of socks or stockings and obtaining the combination of attachment parts, creating the reinforced region by knitting a fabric comprising a combination of a ground thread, a reinforcing thread, and a plating thread into at least the reinforced region of the matching pair of socks or stockings, inserting the reinforcing thread into the reinforced region at a start of each row of the reinforced region in addition to the ground thread, using the reinforcing thread simultaneously with another thread, and severing the reinforcing thread at an end of each row in the reinforced region, arranging the reinforcing thread so that the reinforcing thread is located in the stitch between the ground thread and the plating thread, and attaching a first attachment part firmly to the reinforced region of one of the socks or stockings in order to receive a second complementary attachment part in a removable manner, wherein the reinforced region of each sock or stocking measures up to a circle of at least 1 cm around the attachment part and is knitted according to a plating method with a stitch density of at least 2000 SD, determined according to DIN 53883, wherein the reinforcing thread has a tear resistance corresponding to at least the average tear resistance of the tear resistances of the ground thread, the plating thread, and the reinforcing thread, and wherein the knitted fabric at least in the reinforced region has an average tear resistance of at least 15 cN/tex, none of the threads having a tear resistance of less than 10 cN/tex in the reinforced region, the attachment parts of the removable connection each being fitted thereto, and the attachment part is capable of remaining attached to the reinforced region for a service life of more than 300 interspersed washes wherein the reinforcing thread is not visible from the inside and the outside of the socks or stockings, wherein the leg portion includes an unreinforced region that is free of the reinforcing thread.

* * * * *